US005566409A

United States Patent [19]

Klearman

[11] Patent Number: 5,566,409

[45] Date of Patent: Oct. 22, 1996

[54] MODULAR AIR MATTRESS

[76] Inventor: Jeffrey D. Klearman, #2 Frontenac Pl., St. Louis, Mo. 63131

[21] Appl. No.: 270,168

[22] Filed: Jul. 1, 1994

[51] Int. Cl.[6] ..... A47C 27/10

[52] U.S. Cl. ..... 5/723; 5/706; 5/726; 5/711

[58] Field of Search ..... 5/453, 456, 457, 5/469, 465, 449

[56] References Cited

U.S. PATENT DOCUMENTS

| | | | |
|---|---|---|---|
| 486,696 | 11/1892 | Curlin . | |
| 818,321 | 4/1906 | Whall . | |
| 1,154,776 | 9/1915 | Joseph | 5/465 |
| 3,428,974 | 2/1969 | Stuart | 5/465 X |
| 3,780,388 | 12/1973 | Thomas et al. . | |
| 3,790,975 | 2/1974 | Philipp et al. | 5/457 |
| 4,644,597 | 2/1987 | Walker . | |
| 4,768,249 | 9/1988 | Goodwin . | |
| 5,031,260 | 7/1991 | LaBianco | 5/457 |
| 5,168,589 | 12/1992 | Stroh et al. | 5/453 X |
| 5,249,318 | 10/1993 | Londsman | 5/465 X |
| 5,305,483 | 4/1994 | Watkins | 5/469 X |

FOREIGN PATENT DOCUMENTS 1545806 5/1979 United Kingdom .

*Primary Examiner*—Michael F. Trettel
*Attorney, Agent, or Firm*—Howell & Haferkamp, L.C.

[57] ABSTRACT

A modular air mattress including three separate pieces, one to support the head region, the middle abdomen region, and the lower leg region of a human body, respectively. The mattress pieces include a low air loss ventilating air mattress piece and conventional, non-ventilating mattress pieces. The ventilating mattress piece is positioned to support a body region susceptible to bed sores, while the conventional mattress pieces are positioned to support non-bed-sore susceptible body regions. Each piece has means for releasably coupling to each of the other pieces so that the ventilating air mattress piece and conventional mattress pieces may be conveniently positioned, and securely coupled, in any longitudinal series. The releasable coupling means also facilitates easy and convenient replacement and/or rearrangement of the mattress pieces.

15 Claims, 1 Drawing Sheet

MODULAR AIR MATTRESS

FIELD OF THE INVENTION

This invention relates to a modular air mattress including a ventilating air mattress piece positioned to support either the head, middle abdomen, or lower leg region of a human body as needed to minimize bed sores within said body region, two conventional, non-ventilating mattress pieces positioned to support the remainder of said body regions, and releasably coupling each mattress piece to their adjacent pieces thereby completing a secure, but repositionable, mattress assembly.

BACKGROUND AND SUMMARY OF THE INVENTION

The problem of bed sores and blisters experienced by people confined to bed for extended lengths of time is well documented. The primary cause of bed sores is the immobility of a bed-ridden patient which causes an interruption in the flow of blood to capillaries and areas of the skin adjacent bone protuberances (shoulder blades and heels, for instance). The interruption of blood flow to the capillaries causes skin cells to die which results in a breakdown of skin tissue and the development of bed sores. Further, any build-up of moisture, due to perspiration for example, exacerbates the bed-sore problem.

Ventilating air mattresses have been developed which accept pressurized air through an aperture and have a plurality of pores through their top surfaces enabling a controlled flow of air to escape therethrough. These mattresses are effective in distributing the support of a patient over a greater area of the patient's body, thereby relieving some pressure in the areas of bone protuberances. The controlled flow of air also assists in drying perspiration.

However, the prior art ventilating air mattresses are expensive, inefficient and cumbersome. As illustrated in U.S. Pat. No. 4,768,249 issued to Goodwin and Great Britain Patent No. 1,545,806 issued to Hopkins, the prior art ventilating air mattresses are elaborately constructed. These ventilating air mattresses require a specially tailored bed frame and each inflatable cell must meet precise material tolerances. This elaborate construction significantly increases the unit cost of each bed.

While the prior art mattresses add significant expense to the unit cost of each bed, the mattresses are inefficiently designed. Much of the expense simply does not assist in reducing bed sores. For instance, the prior art mattresses vent air along the entire longitudinal top surface of the mattress resulting in two significant, and costly, inefficiencies. First, as explained above, bed sores are most frequently localized near skin areas adjacent bone proturbances. However, the prior art ventilating air mattresses do not address this localized phenomenon. In the prior art, each body region (head, middle abdomen, and lower legs) of a given patient is supported by the elaborate and expensive mattress design whether or not each body region is susceptible to bed sores. Thus, the elaborate and expensive mattress construction is unnecessarily employed to support body regions unlikely to experience bed sores. Second, the prior art mattresses support the patient's entire weight over the ventilating air surface of the mattress thereby requiring a sizable air pump (often specifically design for this purpose) to maintain appropriate inflation throughout the entire mattress. The additional expense of the oversized air pump and increased operating expense required to continually vent air to non-bed-sore susceptible body regions is wasted.

Further, while ventilating air mattresses have been developed employing multiple separate inflatable cells, those prior art mattresses are designed, manufactured and assembled for permanence. Each cell (from head to toe) is a ventilating air cell, and elaborate mechanisms for attaching the mattress cells to a specialized bed frame, which was often tailored specifically for these ventilating mattresses, is required along with sophisticated pump assemblies. This design criteria creates a sturdy and permanent mattress at the expense of mobility, adaptability and ease of assembly. Therefore, if elevation of the leg region or head region of a given patient (as may be required for a patient's injury or illness) redistributes the patient's body weight relative to the mattress and alters the body regions susceptible to bed sores, the inefficient design of the prior art ventilating air mattress again fails to allow the mattress assembly to adapt to the patient's changing needs. Each body region is continually supported by an expensive ventilating air mattress piece with no concern that repositioning of the body may render specific body regions non-susceptible to bed sores.

Moreover, because the prior art ventilating air mattresses are designed for permanence, if a mattress piece fails or becomes contaminated, it is cumbersome and time-consuming to access an individual piece and quite difficult to replace or reposition individual pieces. As a result, hospitals and nursing homes are required to inventory entire spare beds, and entire spare ventilating air mattresses, to be used as substitutes until a failed/contaminated piece (section) of the original ventilating air mattress is repaired or replaced. This inventory requirement further increases the expense associated with the prior art mattresses.

The present invention overcomes the foregoing problems by providing a modular air mattress having three separate pieces, one to support a head region, one to support a middle abdomen region, and one to support a lower leg region of a patient. The mattress pieces include a low air loss ventilating mattress piece (hereinafter "ventilating air mattress") and two conventional, non-ventilating mattress pieces, which are interchangeable to accommodate a patient's needs. For instance, the considerably more expensive ventilating air mattress piece is only positioned beneath the region of a patient's body deemed susceptible to bed sores, while the less expensive, conventional mattress pieces are positioned beneath the remaining body regions. Each piece has means for releasably coupling to each of the other pieces so that the ventilating air mattress piece and conventional mattress pieces may be conveniently positioned, and securely coupled, in any longitudinal series.

The releasable coupling means facilitates convenient rearrangement, or replacement, of mattress pieces in the event a piece fails or becomes contaminated, or to accommodate a patient's changing needs. The nurse or medical technician begins by selecting a mattress piece to be replaced or rearranged, decoupling the selected piece from its adjacent piece(s), removing the selected piece from the mattress, and replacing/rearranging the piece. The mattress piece is then coupled to its adjacent piece(s).

This invention is a significant improvement over the prior art in that the elaborate and expensive ventilating air mattress pieces are efficiently utilized by selectively positioning the ventilating air mattress pieces to only support bed-sore susceptible body regions. Using conventional mattress pieces to support the non-bed-sore susceptible body regions reduces the unit cost of each bed. Moreover, because ventilating air mattress pieces only support a fraction of a patient's body weight (the conventional mattress pieces support the remainder), a smaller air pump may be used while still maintaining appropriate inflation, thereby further reducing the unit bed cost and correspondingly minimizing the air pump operating expense of this mattress.

Furthermore, the releasable coupling means of this invention allows the mattress pieces to be quickly and conveniently rearranged to accommodate a patient's changing needs or to accommodate a new patient. The releasable coupling means is especially helpful when one mattress piece fails or becomes contaminated. Rather than replacing the entire bed, or taking the bed out of service to repair the damaged mattress piece, when one mattress piece of this invention fails or is contaminated, the piece is very easily replaced by a nurse or medical technician, thereby reducing maintenance costs, freeing medical and maintenance personnel time, and minimizing the cost associated with inventorying entire spare beds and entire spare mattresses.

DETAILED DESCRIPTION OF A PREFERRED EMBODIMENT

Figure 1:
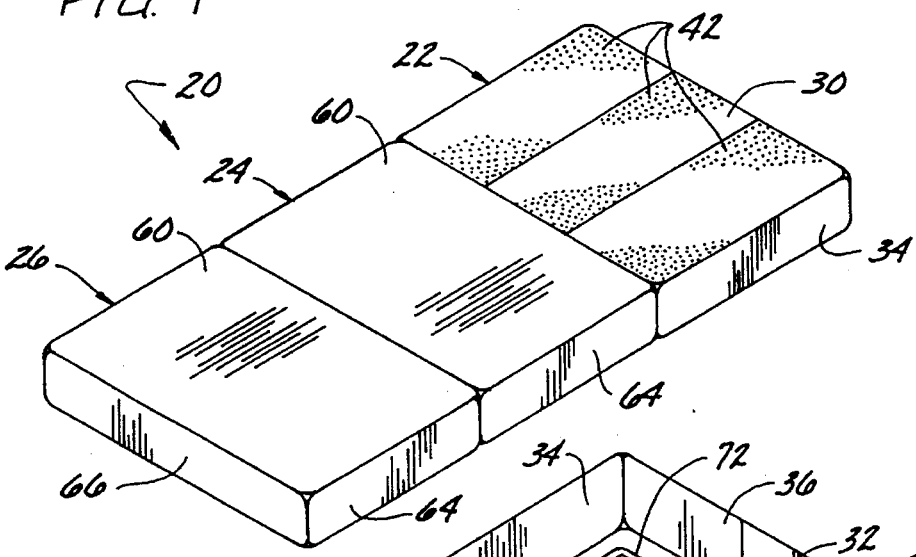
FIG. 1 is an isometric view of the modular mattress constructed according to the principles of this invention, including a ventilating air mattress piece and two conventional mattress pieces.
Figure 2:
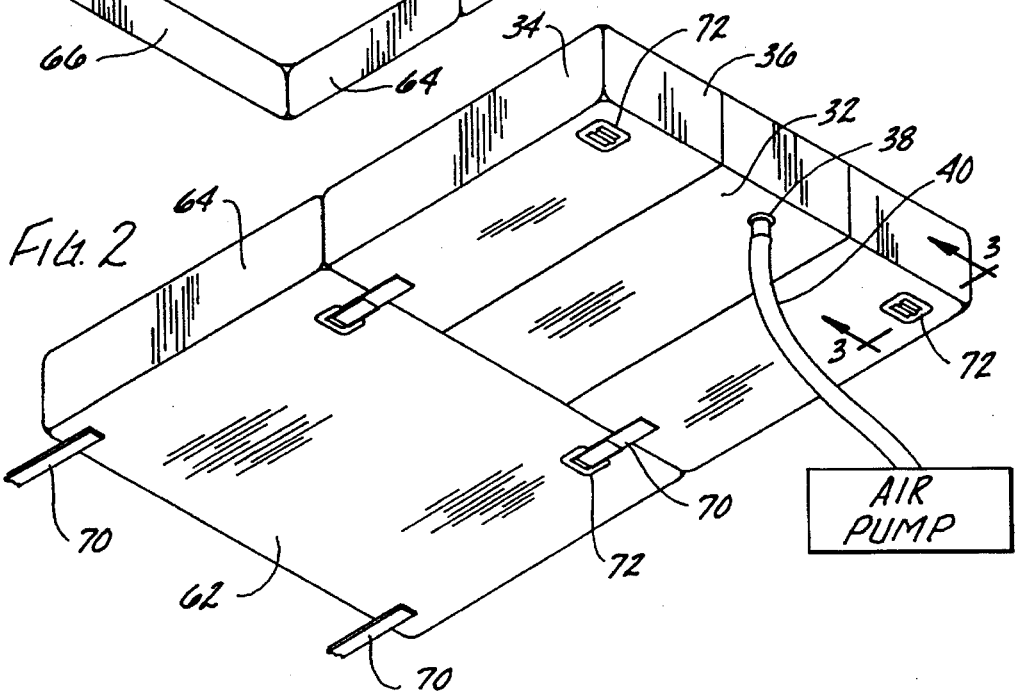
FIG. 2 is an isometric view depicting the bottom of a ventilating air piece and a non-ventilating air piece according to this invention, and illustrating a releasable coupling means therebetween.

A modular air mattress constructed according to the principles of this invention is indicated generally as 20 in FIG. 1. The mattress includes three separate pieces, a head piece 22, a middle abdomen piece 24, and a lower leg piece 26 to support the head, middle abdomen, and lower leg regions of a human body, respectively. Each piece may be either a ventilating air mattress piece (as illustrated by head piece 22) or a conventional, non-ventilating mattress piece (as illustrated by the middle abdomen piece 24 and the lower leg piece 26). The illustration of head piece 22 as a ventilating air mattress piece and pieces 24 and 26 as non-ventilating mattress pieces is not intended as a limitation. Any of the three pieces may comprise a ventilating air mattress piece or a conventional, non-ventilating mattress piece as a patient's needs dictate.

The ventilating air mattress piece includes a top sheet 30 and a bottom sheet 32 secured together in a vertically-spaced relationship by two longitudinal side walls 34 and two end walls 36. An inflatable cavity is defined by top sheet 30, bottom sheet 32, side walls 34, and end walls 36. An aperture 38 extends through the bottom sheet 32 of the ventilating air mattress piece and accepts an air pump hose 40 so that said inflatable cavity may be inflated. The firmness of the ventilating air mattress piece is adjustable by varying the air pump output. A plurality of pores 42 extend through the top sheet 30 of the ventilating air mattress piece enabling air within said cavity to escape through the pores 42.

Figure 3:
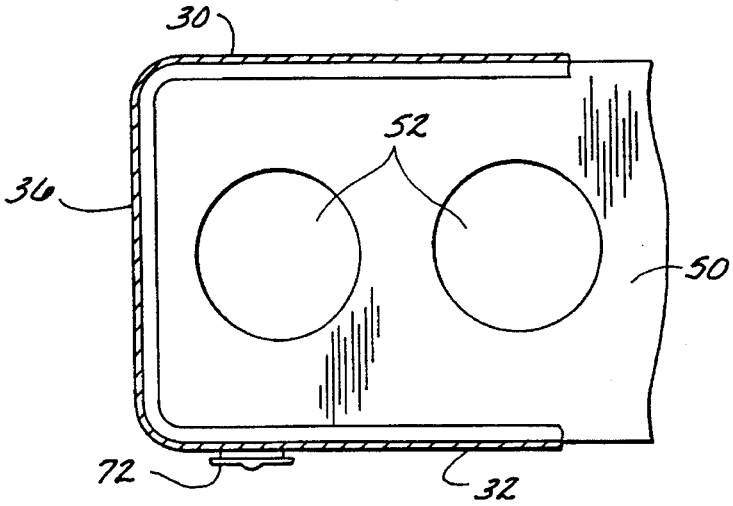
FIG. 3 is a cross-sectional view taken along lines 3—3 in FIG. 2 detailing two apertures through a partition wall within the inflatable cavity of a ventilating air piece and a releasable fastener.

In the preferred embodiment, the inflatable cavity includes three inflatable cells separated by two partition walls 50. Each partition wall includes two apertures 52 (see FIG. 3) allowing air to flow between the cells, the partition walls being otherwise substantially impervious to the passage of air therethrough.

The conventional, non-ventilating mattress pieces each include a top sheet 60, a bottom sheet 62, two longitudinal side walls 64, and two end walls 66. The conventional, non-ventilating mattress pieces may be a conventional air mattress, a foam mattress, or a spring mattress, for example.

Each mattress piece, whether a ventilating air piece or conventional, non-ventilating piece, includes means for releasably coupling to each of the other pieces so that the pieces may be arranged in any longitudinal series. This allows selective positioning of ventilating air mattress pieces to support bed-sore susceptible body regions and selective positioning of conventional mattress pieces to support non-bed-sore susceptible body regions. The releasable coupling means assures that the mattress pieces may be conveniently coupled to adjacent pieces regardless which body regions the ventilating air mattress pieces are positioned to support.

The preferred embodiment shows a pair of VELCRO® hook and loop straps 70 and a pair of buckles 72 attached to each bottom sheet 32 and 62 adjacent opposite end walls 36 and 66 of the bottom sheets respectively. The straps 70 are positioned to substantially align with the buckles 72 of any adjacent mattress piece when the pieces are appropriately arranged end-to-end. The VELCRO® hook and loop straps of one mattress piece are easily looped through the buckles of an adjacent mattress piece creating a pair of strap and buckle fasteners between each adjacent piece to securely couple the mattress pieces together. It is also a simple procedure to remove, replace, or rearrange mattress pieces (without special tools or time-consuming procedures) by unfastening the VELCRO® hook and loop straps from the buckles of an adjacent mattress piece, thereby decoupling said mattress pieces and allowing the pieces to be conveniently removed, replaced, or rearranged.

Although the preferred embodiment (and FIG. 1) illustrates only one ventilating air mattress piece, it is understood that multiple ventilating air mattress pieces can be utilized if multiple body regions are bed-sore susceptible. It is also understood that the strap and buckle fasteners are only one means for releasably coupling adjacent mattress pieces. Other means can be employed without departing from the spirit of this invention. Snaps, buttons, or hook-and-loop fasteners, for example, may be incorporated to effectively releasably couple adjacent pieces. It is also understood that attachment of the releasable coupling means to the mattress pieces is not limited to the bottom sheets 32 and 62. For example, the releasable coupling means may also be attached to the top sheets 30 and 60, the side walls 34 and 64, the end walls 36 and 66, or various combinations thereof.

Although illustrated embodiments of the present invention are described herein with reference to the accompanying drawings, it is to be understood that the invention is not limited to those precise embodiments and that various other changes and modifications may be effected therein by one skilled in the art without departing from the scope or spirit of the invention. The scope of the invention is defined solely by the claims, and their equivalents.

What is claimed is:

1. A modular mattress for supporting a patient comprising at least three separate mattress pieces, at least one of said pieces being a ventilating air piece and at least one other piece being a non-ventilating piece, and at least one connector for releasably coupling said mattress pieces together to thereby selectively position said at least one ventilating air piece with respect to said other pieces in said mattress.

2. The modular mattress of claim 1 wherein said connector includes at least one strap and buckle fastener extending between each of said adjacent pieces to thereby selectively reposition said at least one ventilating air piece with respect to said other pieces.

3. The modular mattress of claim 1 wherein each of said mattress pieces includes two end walls, and wherein said at least one connector comprises mateable straps and buckles connected to said mattress pieces, the straps and buckles being located adjacent opposite end walls such that said straps and buckles may be connected together when said mattress pieces are arranged end to end, in any of at least two series.

4. The modular mattress of claim 1 wherein said ventilating air piece includes a plurality of inflatable cells separated by at least one partition wall, said at least one partition wall having at least one aperture allowing air to flow between said cells, said at least one partition wall being otherwise substantially impervious to the passage of air therethrough.

5. The modular mattress of claim 1 wherein said mattress pieces comprise three mattress pieces, one positioned to support a head region, one positioned to support a middle abdomen region, and one positioned to support a lower leg region of said patient.

6. The modular mattress of claim 1 wherein the mattress pieces and connector are configured such that said mattress pieces may be selectively coupled together in at least two different arrangements.

7. The modular mattress of claim 1 wherein said mattress pieces and connector are configured such that said mattress pieces may be releasably coupled together in a first longitudinal series, and may be releasably coupled together in a second longitudinal series different from the first longitudinal series.

8. The modular mattress of claim 1 wherein:

said ventilating air piece constitutes a first mattress piece;

said non-ventilating piece constitutes a second mattress piece;

another of said mattress pieces constitutes a third mattress piece; and said mattress pieces and connector being configured such that the mattress pieces may be coupled together in a first arrangement in which the first mattress piece is positioned generally between the second and third mattress pieces, and such that the mattress pieces may be rearranged and coupled together in a second arrangement in which the second mattress piece is positioned generally between the first and third mattress pieces.

9. The modular mattress of claim 1 wherein said non-ventilating piece comprises an air mattress.

10. A modular mattress for supporting a patient comprising a plurality of separate pieces positioned adjacent one another in a longitudinal series, at least one of said pieces being a ventilating air piece and at least one other of said pieces being a non-ventilating piece, means for releasably coupling each of said plurality of pieces to said adjacent pieces of said mattress so that said plurality of pieces may be coupled in said longitudinal series and each of said plurality of pieces may be released from said adjacent pieces to selectively reposition said plurality of pieces in another longitudinal series.

11. The modular mattress of claim 10 wherein said releasable coupling means comprises at least one strap and buckle fastener extending between each of said adjacent pieces, each of said pieces having at least one strap and at least one buckle positioned thereon so that said strap and said buckle of adjacent pieces comprise said at least one strap and buckle fastener.

12. The modular mattress of claim 10 wherein said ventilating air piece includes a plurality of inflatable cells separated by at least one partition wall, said at least one partition wall having at least one aperture allowing air to flow between said cells, said at least one partition wall being otherwise substantially impervious to the passage of air therethrough.

13. The modular mattress of claim 12 wherein said separate pieces comprise three pieces, one positioned to support a head region, one positioned to support a middle abdomen region, and one positioned to support a lower leg region of said patient.

14. The modular mattress of claim 10 wherein said non-ventilating piece comprises an air mattress.

15. A modular mattress for supporting a patient comprising a plurality of separate pieces positioned adjacent one another in a longitudinal series, at least one of said pieces being a ventilating air piece and at least one other of said pieces being a non-ventilating piece, and at least one connector for releasably coupling each of said plurality of pieces to said adjacent pieces of said mattress so that said plurality of pieces may be coupled in said longitudinal series and each of said plurality of pieces may be released from said adjacent pieces to selectively reposition said plurality of pieces in another longitudinal series.

* * * * *